US012768353B2

(12) United States Patent
Bae et al.

(10) Patent No.: US 12,768,353 B2
(45) Date of Patent: Oct. 20, 2026

(54) SCROLL COMPRESSOR WITH A BEARING SUPPORT AND DUAL BEARINGS

(71) Applicant: SAMSUNG ELECTRONICS CO., LTD., Suwon-si (KR)

(72) Inventors: Mooseong Bae, Suwon-si (KR); Jongsoo Noh, Suwon-si (KR); Inwon Park, Suwon-si (KR); Sanghun Seong, Suwon-si (KR); Jaesang Lee, Suwon-si (KR); Sungchan Cho, Suwon-si (KR); Yanghee Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 18/886,199

(22) Filed: Sep. 16, 2024

(65) Prior Publication Data

US 2025/0101976 A1 Mar. 27, 2025

Related U.S. Application Data

(63) Continuation of application No. PCT/KR2024/010293, filed on Jul. 17, 2024.

(30) Foreign Application Priority Data

Sep. 22, 2023 (KR) ..... 10-2023-0127455
Nov. 30, 2023 (KR) ..... 10-2023-0171116

(51) Int. Cl.
*F04C 18/02* (2006.01)
*F04C 29/00* (2006.01)

(52) U.S. Cl.
CPC ..... *F04C 18/0215* (2013.01); *F04C 29/0057* (2013.01); *F04C 2240/50* (2013.01); *F04C 2240/60* (2013.01); *F04C 2240/807* (2013.01)

(58) Field of Classification Search
CPC ..... F04C 18/0215; F04C 29/0057; F04C 2240/50; F04C 2240/60; F04C 2240/807
See application file for complete search history.

(56) References Cited

U.S. PATENT DOCUMENTS 4,575,320 A * 3/1986 Kobayashi ..... F04C 29/023 418/94
7,604,465 B2 10/2009 Fujita et al.
(Continued)

FOREIGN PATENT DOCUMENTS

JP 7-247978 9/1995
JP 2923582 B2 7/1999
(Continued)

OTHER PUBLICATIONS

International Search Report issued on Oct. 21, 2024 for International Application No. PCT/KR2024/010293.

*Primary Examiner* — Mary A Davis
(74) *Attorney, Agent, or Firm* — STAAS & HALSEY LLP

(57) ABSTRACT

A scroll compressor can include a frame including a shaft hole, a fixed scroll on an upper side of the frame, an orbiting scroll between the fixed scroll and the frame, a lower surface of the orbiting scroll including a boss inserted into the shaft hole, a rotatable shaft including an eccentric portion inserted into the boss and inserted into the shaft hole, a first bearing in the shaft hole between the shaft hole and a bearing support coupled to an outer circumferential surface of the rotating shaft, an inner circumferential surface of the first bearing being supported by an outer circumferential surface of the bearing support, the bearing support being separatable from, and couplable to, the rotating shaft, and a second bearing between the boss and the eccentric portion so that a location
(Continued)

of the second bearing overlaps the first bearing in an axial direction of the rotatable shaft.

11 Claims, 12 Drawing Sheets

(56) References Cited

U.S. PATENT DOCUMENTS

| | | | |
|---|---|---|---|
| 10,480,508 | B2 | 11/2019 | Matsui et al. |
| 11,092,154 | B2 | 8/2021 | Choi et al. |
| 11,193,490 | B2 | 12/2021 | Kuma et al. |
| 2007/0292293 | A1 | 12/2007 | Fujita et al. |
| 2013/0089451 | A1 | 4/2013 | Ahn et al. |

FOREIGN PATENT DOCUMENTS

| | | | |
|---|---|---|---|
| KR | 10-2007-0119477 | | 12/2007 |
| KR | 10-2010-0058821 | A | 6/2010 |
| KR | 10-2013-0037115 | | 4/2013 |
| KR | 10-2002125 | B1 | 7/2019 |
| KR | 10-2020-0004748 | | 1/2020 |
| KR | 10-2124491 | B1 | 6/2020 |
| KR | 10-2507721 | B1 | 3/2023 |
| WO | WO 2020/009466 | A1 | 1/2020 |
| WO | WO 2021/124500 | A1 | 6/2021 |

* cited by examiner

SCROLL COMPRESSOR WITH A BEARING SUPPORT AND DUAL BEARINGS

CROSS-REFERENCE TO RELATED APPLICATIONS

This application is a continuation application, claiming priority under § 365(c), of an International application No. PCT/KR2024/010293, filed on Jul. 17, 2024, which is based on and claims the benefit of a Korean patent application number 10-2023-0127455, filed on Sep. 22, 2023, in the Korean Intellectual Property Office, and of a Korean patent application number 10-2023-0171116, filed on Nov. 30, 2023, in the Korean Intellectual Property Office, the disclosure of each of which is incorporated by reference herein in its entirety.

BACKGROUND

1. Field

The disclosure relates to a scroll compressor, and more particularly, to a scroll compressor in which a first bearing disposed between a main frame and a rotating shaft and a second bearing disposed between an orbiting scroll and the rotating shaft are arranged to overlap in an axial direction.

2. Description of the Related Art

A compressor is a mechanical device that increases pressure by compressing air, refrigerant, or various other working gases using a motor, a turbine, or the like. The compressor is used in a variety of ways throughout industries.

When a compressor is used in a refrigerant cycle, it may convert low pressure refrigerant into high pressure refrigerant and deliver it back to the condenser.

Compressors may be broadly classified into a reciprocating compressor that forms a compression space between a piston and a cylinder where a refrigerant is sucked in and discharged and compresses the refrigerant while the piston reciprocates linearly inside the cylinder, a rotary compressor that forms a compression space between an eccentrically rotating rolling piston and a cylinder where a refrigerant is sucked in and discharged and compresses the refrigerant while the rolling piston rotates eccentrically along the inner wall of the cylinder, and a scroll compressor that forms a compression space between an orbiting scroll and a fixed scroll where a refrigerant is sucked in and discharged and compresses the refrigerant while the orbiting scroll rotates relative to the fixed scroll.

The scroll compressor is widely used in the refrigeration cycle device because it has higher efficiency, lower vibration and noise and can be compact and light weight compared to the reciprocating compressor or the rotary compressor.

SUMMARY

According to one or more embodiments of the disclosure, a scroll compressor may include: a main frame including a shaft hole; a fixed scroll disposed on an upper side of the main frame; an orbiting scroll disposed in a space formed by the fixed scroll and the main frame, a lower surface of the orbiting scroll including a boss inserted into the shaft hole of the main frame; a rotatable shaft including an eccentric portion inserted into the boss of the orbiting scroll and inserted into the shaft hole of the main frame; a first bearing disposed in the shaft hole between the shaft hole of the main frame and a bearing support coupled to an outer circumferential surface of the rotatable shaft, an inner circumferential surface of the first bearing being supported by an outer circumferential surface of the bearing support, the bearing support being separatable from, and couplable to, the rotatable shaft; and a second bearing disposed between the boss of the orbiting scroll and the eccentric portion of the rotatable shaft so that a location of the second bearing overlaps the first bearing in an axial direction of the rotatable shaft.

According to one or more embodiments of the disclosure, the bearing support may have a hollow cylindrical shape and may be press-fit to an outer circumferential surface of an upper end of the rotatable shaft.

According to one or more embodiments of the disclosure, the upper end of the rotatable shaft may include a step portion that is located below the eccentric portion and to which the bearing support is coupled.

According to one or more embodiments of the disclosure, the inner circumferential surface of the bearing support may be eccentric with respect to the outer circumferential surface of the bearing support.

According to one or more embodiments of the disclosure, the scroll compressor may further include: a balance weight disposed on the rotatable shaft wherein the bearing support may integrally extend upward from the balance weight in the axial direction of the rotatable shaft.

According to one or more embodiments of the disclosure, the rotatable shaft may be press-fit into a fixing hole of the balance weight so that the rotatable shaft and balance weight are coupled.

According to one or more embodiments of the disclosure, the bearing support may include an oil hole.

According to one or more embodiments of the disclosure, the first bearing and the second bearing may be oilless bearings.

According to one or more embodiments of the disclosure, an outer circumferential surface of the first bearing may be fixed to the shaft hole of the main frame, and an inner circumferential surface of the first bearing may rotatably support the outer circumferential surface of the bearing support.

According to one or more embodiments of the disclosure, an outer circumferential surface of the second bearing may be fixed to an inner circumferential surface of the boss of the orbiting scroll, and an inner circumferential surface of the second bearing may rotatably support an outer circumferential surface of the eccentric portion of the rotatable shaft.

According to one or more embodiments of the disclosure, a scroll compressor may include: a main frame including a shaft hole; a fixed scroll disposed on an upper side of the main frame; an orbiting scroll disposed in a space formed by the fixed scroll and the main frame, a lower surface of the orbiting scroll including a boss inserted into the shaft hole of the main frame; a rotatable shaft including an eccentric portion inserted into the boss of the orbiting scroll and inserted into the shaft hole of the main frame; a first bearing disposed in the shaft hole between the shaft hole of the main frame and the rotatable shaft; a second bearing disposed between the boss of the orbiting scroll and the eccentric portion of the rotatable shaft; and a bearing support having a hollow cylindrical shape, the bearing support being separatable from, and couplable to, an outer circumferential surface of an upper end of the rotatable shaft to support an inner circumferential surface of the first bearing wherein a portion of the second bearing may be located in the hollow of the bearing support.

According to one or more embodiments of the disclosure, a lower end of the second bearing may be located below an upper end of the first bearing in an axial direction of the rotatable shaft.

According to one or more embodiments of the disclosure, the bearing support may be press-fit to an outer circumferential surface of an upper end of the rotatable shaft.

According to one or more embodiments of the disclosure, the scroll compressor may further include: a balance weight disposed on the rotatable shaft below the main frame wherein the bearing support may integrally extend upward from the balance weight in an axial direction of the rotatable shaft.

According to one or more embodiments of the disclosure, the balance weight may include a fixing hole which is eccentric with the hollow of the bearing support and the rotatable shaft is press-fit into the fixing hole of the balance weight so that the rotatable shaft and the balance weight are coupled.

BRIEF DESCRIPTION OF THE DRAWINGS

These and/or other aspects, features, and advantages of certain embodiments of the disclosure will be more apparent from the following description taken in conjunction with the accompanying drawings, in which.

DETAILED DESCRIPTION OF THE EMBODIMENTS

Figure 1:
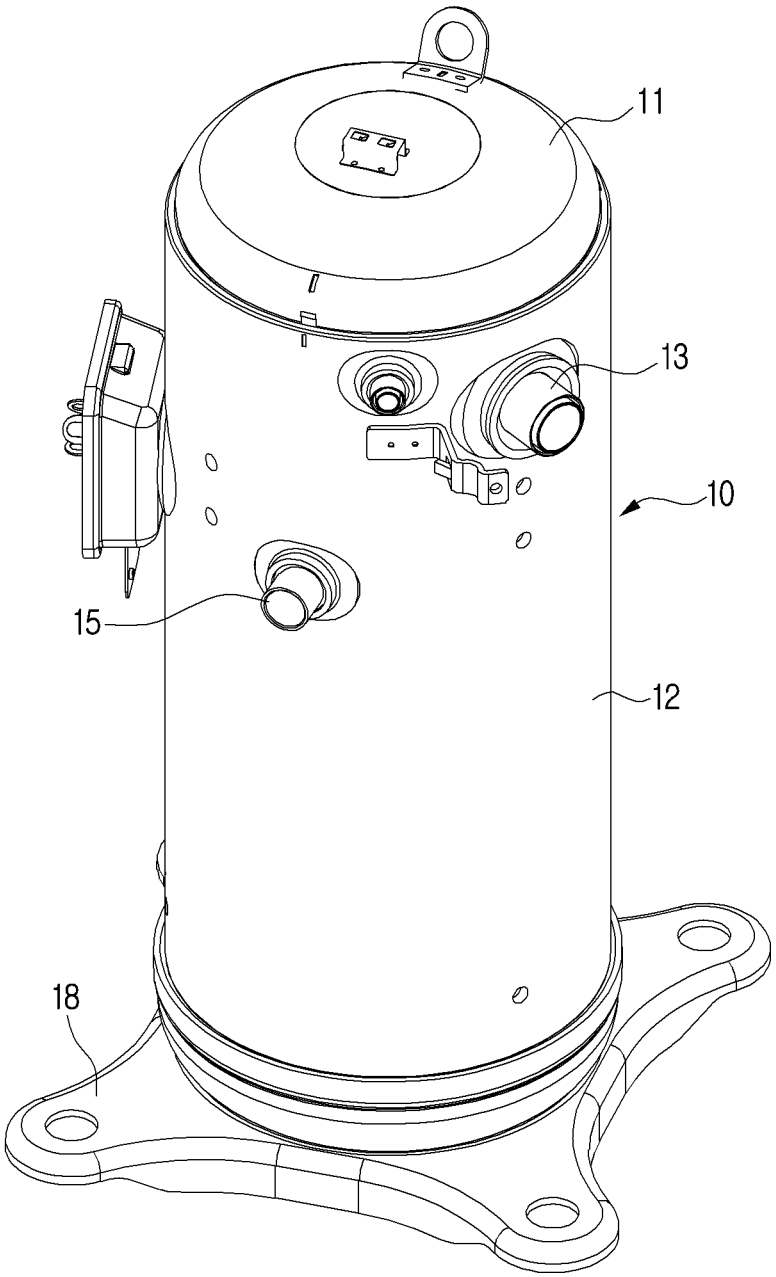
FIG. 1 is a perspective view illustrating a scroll compressor according to one or more embodiments of the disclosure.

Various embodiments of this document and terms used herein are not intended to limit the technical features described in this document to specific embodiments, but should be understood to include various modifications, equivalents, or alternatives of the embodiments.

In connection with the description of the drawings, similar reference numbers may be used for similar or related components.

The singular form of a noun corresponding to an item may include one or more of the above item, unless the relevant context clearly indicates otherwise.

In this document, each of phrases such as "A or B," "at least one of A and B," "at least one of A or B," "A, B, or C," "at least one of A, B, and C," "at least one of A, B, C" may include any one of the items listed together with the corresponding phrase, or any possible combination thereof.

The term "and/or" includes any element of a plurality of related described elements or a combination of a plurality of related described elements.

Terms such as "first," "second," "primary," or "secondary" may be used simply to distinguish one component from other components, and do not limit the corresponding components in other respects (e.g., importance or order).

When it is mentioned that one (e.g., first) component is "coupled" or "connected" to another (e.g., second) component with or without terms "functionally" or "communicatively", it means that the one component can be connected to the another component directly (e.g., wired), wirelessly, or through a third component.

Terms such as "include" or "have" are intended to designate the presence of features, numbers, steps, operations, components, parts, or combinations thereof described in the embodiment, but do not preclude the presence or addition of one or more other features, numbers, steps, operations, components, parts, or combination thereof.

When a component is said to be "connected," "coupled," "supported," or "in contact" with another component, this means not only cases where the components are directly connected, coupled, supported, or contacted, but also cases where the components are indirectly connected, coupled, supported, or contacted through a third component.

When a component is said to be located "on" other component, this includes not only cases where the component is in contact with the other component, but also cases where another component exits between the two components.

Further, the terms 'leading end', 'rear end', 'upper side', 'lower side', 'top end', 'bottom end', etc. used in the disclosure are defined with reference to the drawings. However, the shape and position of each component are not limited by the terms.

The disclosure relates to a scroll compressor that can reduce a friction loss of a second bearing and a manufacturing cost of a rotating shaft by forming a bearing support separately from the rotating shaft so that an outer circumferential surface of an eccentric portion of the rotating shaft can be ground by external cylindrical grinding when a first bearing disposed between the rotating shaft and a main frame and a second bearing disposed between the rotating shaft and an orbiting scroll overlap in an axial direction.

Hereinafter, a scroll compressor 1 according to one or more embodiments of the disclosure will be described in detail with reference to FIGS. 1 to 7.

Figure 2:
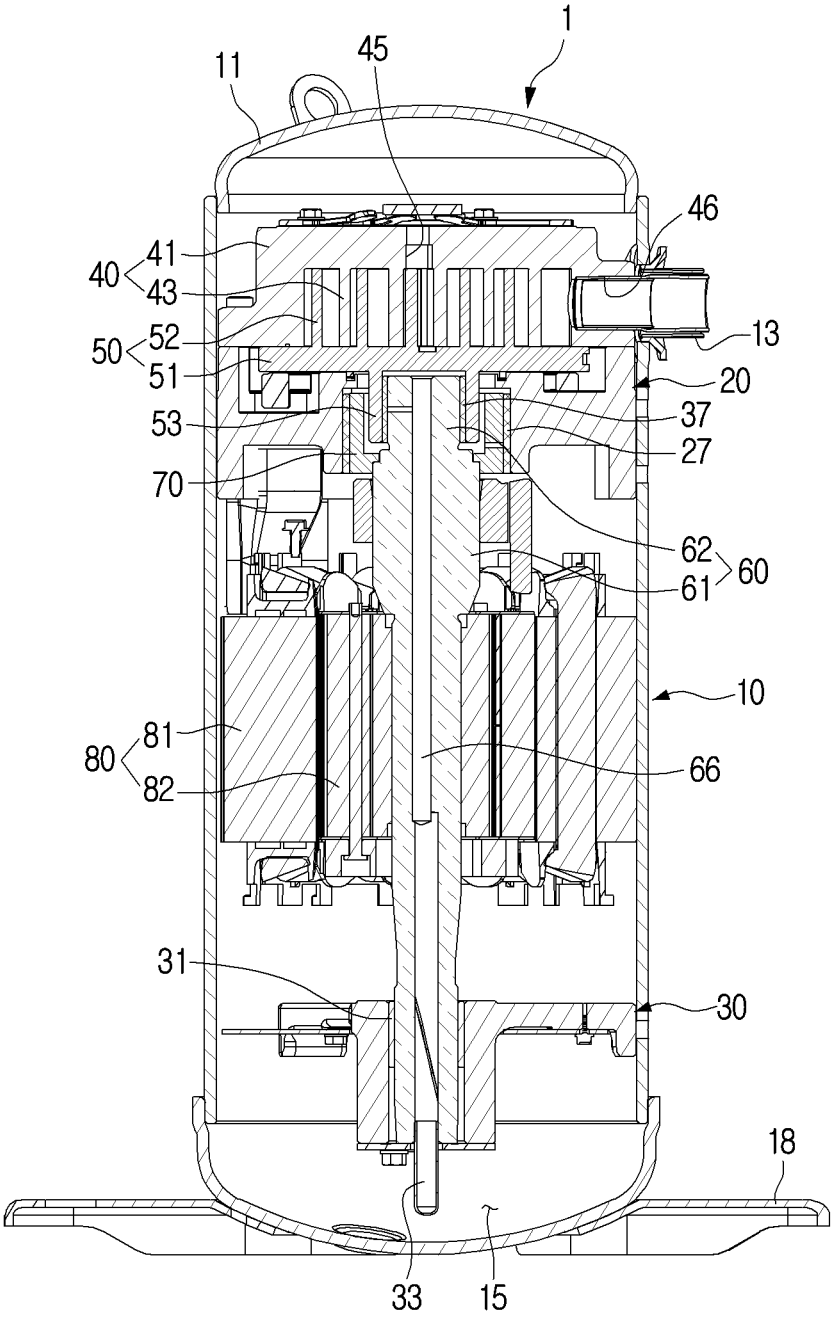
FIG. 2 is a cross-sectional view illustrating a scroll compressor according to one or more embodiments of the disclosure.
Figure 3:
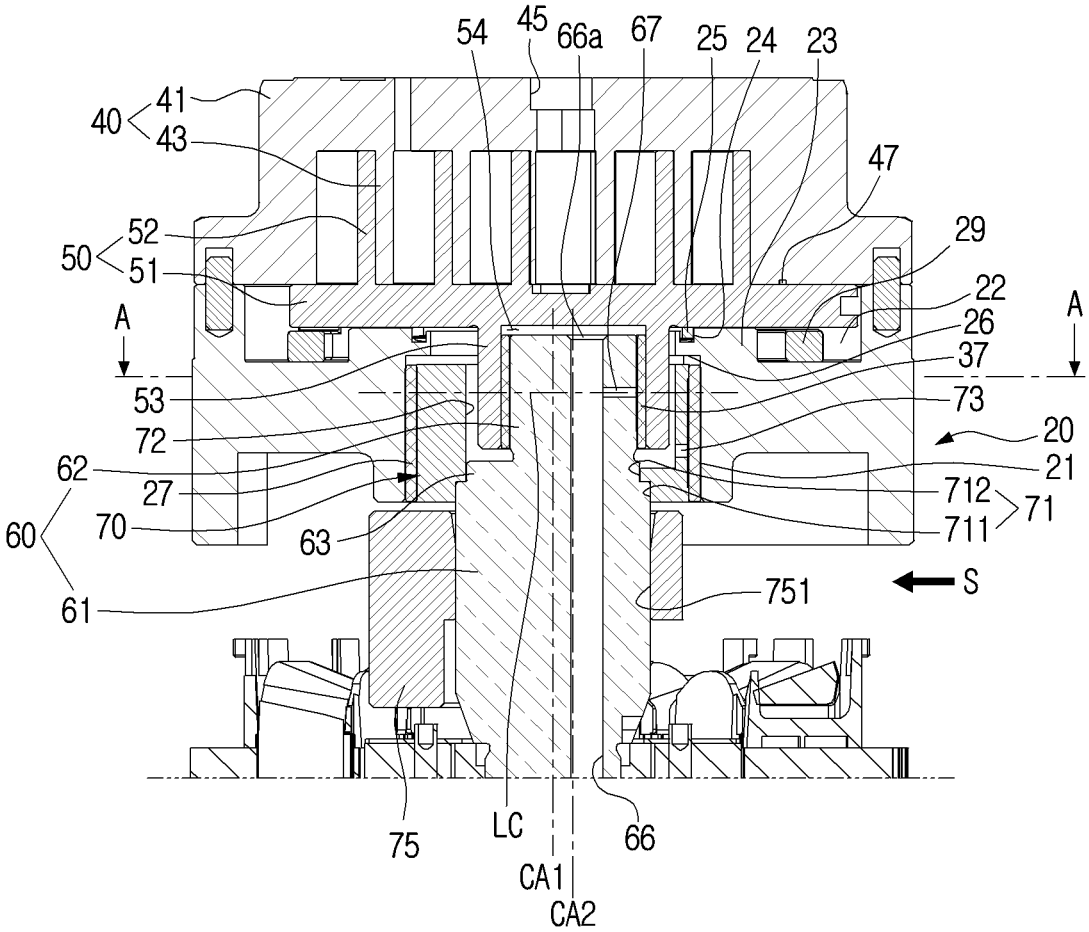
FIG. 3 is a partially enlarged cross-sectional view illustrating a compression part of a scroll compressor according to one or more embodiments of the disclosure.
Figure 4:
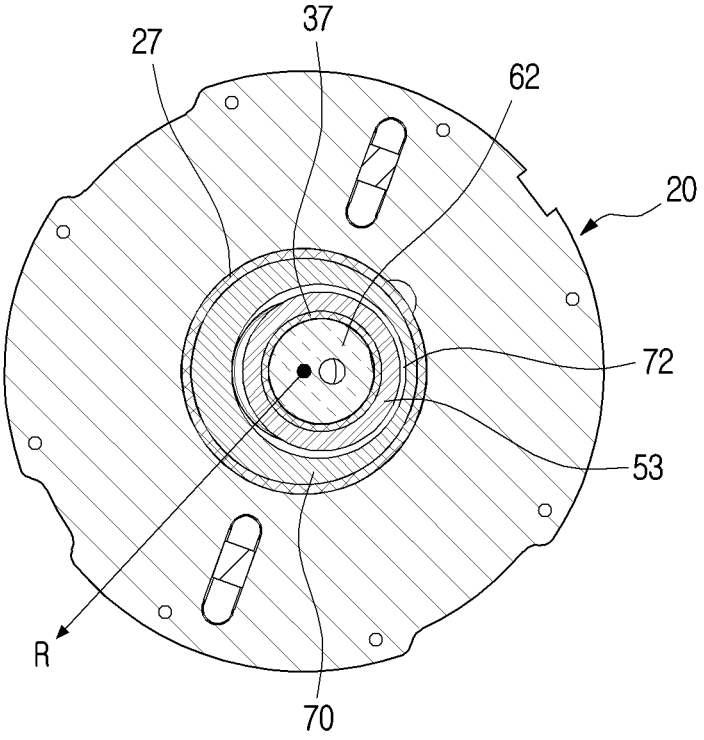
FIG. 4 is a cross-sectional view illustrating the compression part of the scroll compressor of FIG. 3 taken along line A-A.
Figure 5:
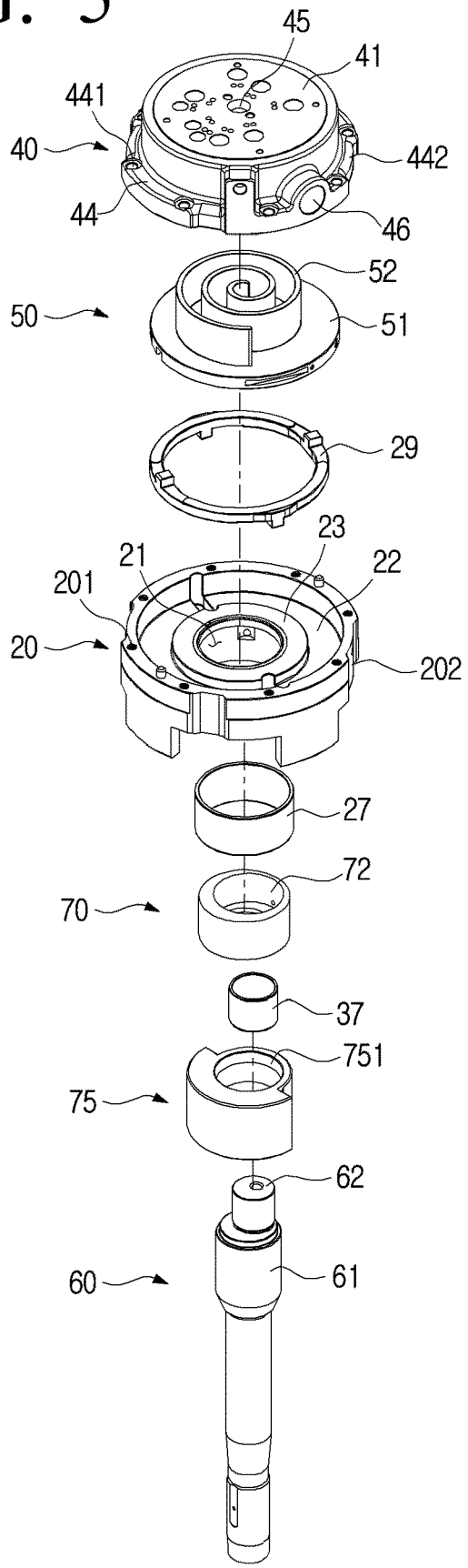
FIG. 5 is an exploded perspective view illustrating main parts of a scroll compressor according to one or more embodiments of the disclosure.
Figure 6:
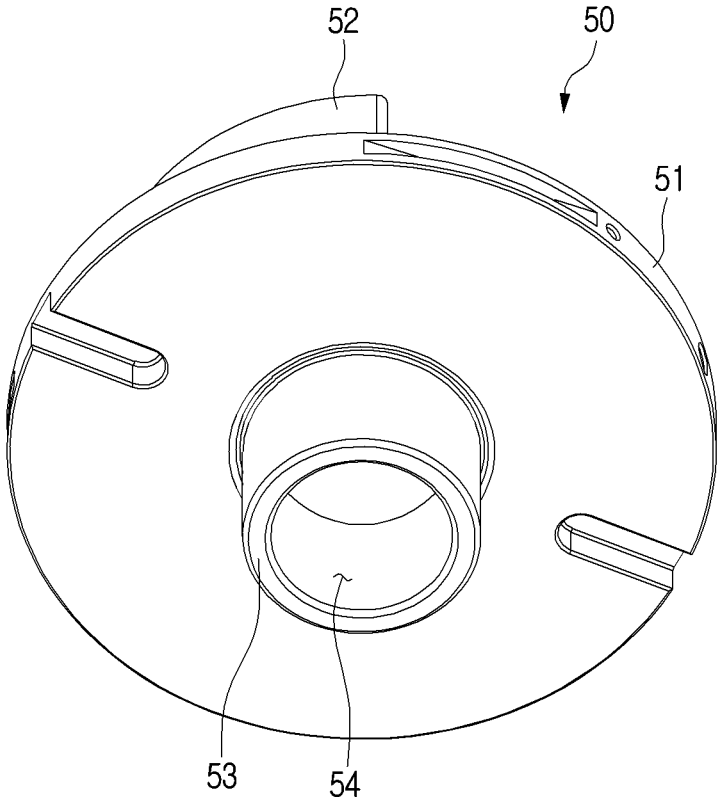
FIG. 6 is a bottom perspective view illustrating an orbiting scroll of a scroll compressor according to one or more embodiments of the disclosure.
Figure 7:
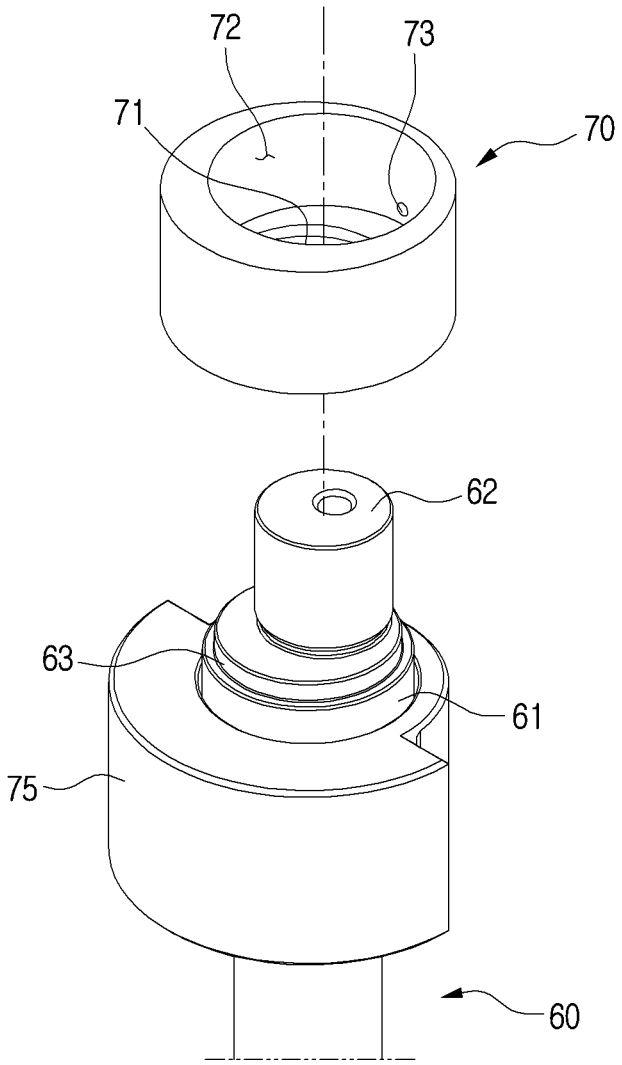
FIG. 7 is a partial perspective view illustrating a bearing support and an eccentric portion of a rotating shaft of a scroll compressor according to one or more embodiments of the disclosure.

FIG. 1 is a perspective view illustrating a scroll compressor 1 according to one or more embodiments of the disclosure. FIG. 2 is a cross-sectional view illustrating a scroll compressor 1 according to one or more embodiments of the disclosure. FIG. 3 is a partially enlarged cross-sectional view illustrating a compression part of a scroll compressor 1 according to one or more embodiments of the disclosure. FIG. 4 is a cross-sectional view illustrating the compression part of the scroll compressor 1 of FIG. 3 taken along line A-A. FIG. 5 is an exploded perspective view illustrating main parts of a scroll compressor 1 according to one or more embodiments of the disclosure. FIG. 6 is a bottom perspective view illustrating an orbiting scroll 50 of a scroll compressor 1 according to one or more embodiments of the disclosure. FIG. 7 is a partial perspective view illustrating a bearing support 70 and an eccentric portion 62 of a rotating shaft 60 of a scroll compressor 1 according to one or more embodiments of the disclosure.

Referring to FIGS. 1 to 5, a scroll compressor 1 according to one or more embodiments of the disclosure may include a casing 10, a main frame 20, a sub frame 30, a fixed scroll 40, an orbiting scroll 50, a rotating shaft 60, and a drive motor 80.

The casing 10 is an airtight container having a cylindrical shape and may include an upper casing 11 and a lower casing 12. The casing 10 may be formed to accommodate the main frame 20, the sub frame 30, the fixed scroll 40, the orbiting scroll 50, the rotating shaft 60, and the drive motor 80.

The casing 10 may be provided with a refrigerant inlet pipe 13 through which refrigerant is introduced and a refrigerant discharge pipe 15 through which the refrigerant is discharged.

The refrigerant inlet pipe 13 penetrates the casing 10 and has one end connected to the fixed scroll 40. The refrigerant discharge pipe 15 penetrates the casing 10, and one end thereof may communicate with the inside of the casing 10.

Therefore, the refrigerant may flow into the fixed scroll 40 disposed in the casing 10 through the refrigerant inlet pipe 13, and the compressed refrigerant discharged from the fixed scroll 40 may be discharged to the outside of the casing 10 through the refrigerant discharge pipe 15.

A base 18 supporting the casing 10 may be provided at the bottom of the lower casing 12. The scroll compressor 1 may be disposed perpendicular to the support surface by means of the base 18.

The main frame 20 and the sub frame 30 are spaced apart at a predetermined distance vertically. The main frame 20 and the sub frame 30 are fixed inside the casing 10. The drive motor 80 that rotates the orbiting scroll 50 is disposed between the main frame 20 and the sub frame 30.

The fixed scroll 40 and the orbiting scroll 50 may be disposed on the upper side of the main frame 20.

An oil reservoir 16 storing oil or lubricating oil for lubricating and cooling parts accommodated inside the casing 10 may be provided below the sub frame 30 in a lower portion of the casing 10.

The main frame 20 may be formed in a substantially disc shape. A shaft hole 21 may be formed in the main frame 20. The shaft hole 21 may be formed at the center of the main frame 20. A first bearing 27 supporting the rotating shaft 60 may be disposed in the shaft hole 21.

The shaft hole 21 may be formed to have a step portion 26. The step portion 26 may be formed at the upper end of the shaft hole 21, that is, at a portion adjacent to the orbiting scroll 50. The step portion 26 may be formed in a ring shape. The step portion 26 may be formed along the entire circumference of the shaft hole 21. The step portion 26 is formed to have a diameter smaller than the diameter of the shaft hole 21. The step portion 26 is formed to have the diameter smaller than the inner diameter of the first bearing 27.

The first bearing 27 is formed in a hollow cylindrical shape. The outer circumferential surface of the first bearing 27 may be fixed to the shaft hole 21 of the main frame 20. The inner circumferential surface of the first bearing 27 may support the rotation of the rotating shaft 60.

The first bearing 27 may be formed as an oilless bearing. For example, the first bearing 27 may be formed as a DU bush.

A receiving groove 22 may be provided on the upper surface of the main frame 20. The receiving groove 22 may be formed at a predetermined depth on the upper surface of the main frame 20. Here, the upper surface of the main frame 20 refers to one surface of the main frame 20 on which the fixed scroll 40 is disposed.

The receiving groove 22 may be formed as a circular groove. The bottom surface of the receiving groove 22 may be formed to be flat. The shaft hole 21 may be formed at the bottom of the receiving groove 22.

An upper protrusion 23 may be formed at the bottom of the receiving groove 22. The upper protrusion 23 may be formed at the edge of the shaft hole 21. The upper protrusion 23 may be formed to protrude upward from the bottom of the receiving groove 22. The upper protrusion 23 may be formed along the entire circumference of the shaft hole 21. The upper protrusion 23 may be formed in a ring shape.

A sealing groove 24 may be formed on the upper surface of the upper protrusion 23. The sealing groove 24 may be formed adjacent to the shaft hole 21. The sealing groove 24 may be formed at the step portion 26. The sealing groove 24 may be formed in a ring shape. The sealing groove 24 may be formed at a predetermined depth on the upper surface of the upper protrusion 23. For example, the cross-section of the sealing groove 24 may be formed in a U-shape with a substantially flat bottom. A seal 25 may be disposed in the sealing groove 24.

An Oldham's ring 29 may be disposed on the bottom of the receiving groove 22. In other words, the Oldham's ring 29 may be disposed between the upper protrusion 23 and the side wall of the main frame 20. The Oldham's ring 29 is disposed to prevent the orbiting scroll 50 from rotating.

A plurality of installation holes 201 to which the fixed scroll 40 is fixed may be provided at the edge of the upper surface of the main frame 20. In detail, the plurality of installation holes 201 may be formed around the receiving groove 22 on the upper surface of the main frame 20. A female thread may be formed on the inner surface of each of the plurality of installation holes 201.

A plurality of first refrigerant passages 202 may be provided on the outer circumferential surface of the main frame 20. The plurality of first refrigerant passages 202 may be formed as grooves connecting the upper and lower surfaces of the main frame 20.

The fixed scroll 40 is disposed on the upper surface of the main frame 20. The fixed scroll 40 is disposed to cover the receiving groove 22 of the main frame 20. The fixed scroll 40 may be fixed to the plurality of installation holes 201 formed on the upper surface of the main frame 20 with a plurality of bolts. The orbiting scroll 50 may be accommodated in the space formed by the fixed scroll 40 and the main frame 20.

The orbiting scroll 50 is engaged with the fixed scroll 40 and is disposed between the fixed scroll 40 and the main frame 20 so that the orbiting scroll 50 may orbit with respect to the fixed scroll 40.

The fixed scroll 40 may include a wrap accommodation portion 41, a fixing portion 44 provided around the wrap accommodation portion 41, and a fixed wrap 43 provided in the inner space of the wrap accommodation portion 41.

The wrap accommodation portion 41 may be formed in a shape that is able to be accommodated inside the casing 10. The wrap accommodation portion 41 may be accommodated inside the casing 10 and may be formed in a substantially hollow cylindrical shape. For example, the wrap accommodation portion 41 may include a side wall having a cylindrical shape and an upper plate formed to block the upper end of the side wall.

The fixing portion 44 extending outward may be provided at the lower end of the wrap accommodation portion 41. The lower surface of the fixing portion 44, that is, the surface in contact with the mirror plate 51 of the orbiting scroll 50 forms a thrust surface.

A plurality of through holes 441 for coupling with the main frame 20 may be provided at the edge of the fixing portion 44. Accordingly, the fixed scroll 40 may be fixed to the plurality of installation holes 201 of the main frame 20 with a plurality of bolts inserted into the plurality of through holes 441 of the fixing portion 44.

In addition, a plurality of second refrigerant passages 442 may be provided at the edge of the fixing portion 44. The plurality of second refrigerant passages 442 may be formed as grooves connecting the upper and lower surfaces of the fixing portion 44.

The plurality of second refrigerant passages 442 may be formed to correspond to the plurality of first refrigerant passages 202 of the main frame 20. The refrigerant discharged to the upper side of the fixed scroll 40 may be moved to the lower side of the main frame 20 through the plurality of first refrigerant passages 202 of the main frame 20 and the plurality of second refrigerant passages 442 of the fixed scroll 40.

The upper plate of the wrap accommodation portion 41 is formed in a disk shape, and may be provided with the discharge port 45 through which refrigerant is discharged and a plurality of bypasses. A check valve configured to open and close the discharge port 45 and a plurality of bypass valves configured to open and close the plurality of bypasses may be provided on the upper surface of the upper plate.

A fixed mirror surface may be formed on the lower surface of the upper plate facing the orbiting scroll 50. Accordingly, the upper end of the orbiting wrap 52 of the orbiting scroll 50 may contact the fixed mirror surface of the fixed scroll 40.

The fixed wrap 43 is provided in the wrap accommodation portion 41. The fixed wrap 43 extends perpendicularly from the fixed mirror surface of the wrap accommodation portion 41 and may be formed as a spiral curved surface having a predetermined thickness and height. For example, the fixed wrap 43 may be formed as an involute curve, an algebraic spiral curve, a hybrid curve, etc.

A spiral-shaped space, that is, a spiral space is formed in the inner space of the wrap accommodation portion 41 by the fixed wrap 43. The orbiting wrap 52 of the orbiting scroll 50 is inserted into the spiral space of the wrap accommodation portion 41 of the fixed scroll 40.

The discharge port 45 may be formed at the center of the wrap accommodation portion 41 so as to penetrate the upper plate of the wrap accommodation portion 41. In other words, the discharge port 45 may be formed adjacent to the center of the spiral space formed by the fixed wrap 43.

An inlet 46 through which refrigerant flows may be formed on a side surface of the fixed scroll 40. The inlet 46 may be connected to the refrigerant inlet pipe 13 disposed in the casing 10. Accordingly, the refrigerant introduced through the refrigerant inlet pipe 13 may be drawn into the fixed scroll 40 through the inlet 46.

In detail, the inlet 46 is formed to penetrate the side wall of the wrap accommodation portion 41. The inlet 46 may be formed adjacent to an outer end of the spiral space formed in the wrap accommodation portion 41. Accordingly, the refrigerant may flow into the spiral space of the fixed scroll 40 through the inlet 46.

An oil groove 47 may be formed on the lower surface, that is, the thrust surface of the fixed scroll 40. The oil groove 47 may be formed at a predetermined depth on the thrust surface. For example, the cross-section of the oil groove 47 may be formed in a substantially U-shape with a flat bottom. The oil groove 47 may be formed in an arc shape surrounding the inner space of the wrap accommodation portion 41.

The orbiting scroll 50 is disposed below the fixed scroll 40 so as to be able to rotate with respect to the fixed scroll 40.

Referring to FIGS. 2 to 6, the orbiting scroll 50 may include a mirror plate 51, an orbiting wrap 52, and a boss 53.

The mirror plate 51 may be formed in a disk shape having a predetermined thickness and area. An orbiting mirror surface may be formed on the upper surface of the mirror plate 51 facing the fixed scroll 40.

The orbiting wrap 52 extends vertically from the upper surface of the mirror plate 51, that is, the orbiting mirror surface, and may be formed in a spiral shape. The orbiting wrap 52 may be formed to engage with the fixed wrap 43 of the fixed scroll 40.

The orbiting wrap 52 may be formed as a curved surface having a predetermined thickness and height. For example, the orbiting wrap 52 may be formed as an involute curve, an algebraic curve, a hybrid curve, etc.

The fixed wrap 43 of the fixed scroll 40 and the orbiting wrap 52 of the orbiting scroll 50 are accommodated in the wrap accommodation portion 41 of the fixed scroll 40. The inner space of the wrap accommodation portion 41 of the fixed scroll 40 forms a compression chamber.

The fixed wrap 43 and the orbiting wrap 52 engaged with each other form the compression chamber, that is, a plurality of compression pockets. When the orbiting scroll 50 rotates, the plurality of compression pockets compress the refrigerant drawn into the inlet 46 of the fixed scroll 40 while moving to the center of the wrap accommodation portion 41 and discharge the compressed refrigerant through the discharge port 45.

The boss 53 may be formed at the center of the lower surface of the mirror plate 51 opposite to the orbital mirror surface. The boss 53 is formed to extend downward from the lower surface of the mirror plate 51. The boss 53 may be formed in a hollow cylindrical shape with one end closed. The outer diameter of the boss 53 may be smaller than the inner diameter of the step portion 26 of the main frame 20.

The upper end of the rotating shaft 60 may be inserted into the hole 54 of the boss 53. That is, the eccentric portion 62 provided at the upper end of the rotating shaft 60 is inserted into the boss 53.

A second bearing 37 may be disposed in the hole 54 of the boss 53. The second bearing 37 is disposed to support the eccentric portion 62 of the rotating shaft 60. The second bearing 37 may be formed to have a length corresponding to the length of the eccentric portion 62 of the rotating shaft 60. For example, the length of the second bearing 37 may be equal to or shorter than the length of the eccentric portion 62 of the rotating shaft 60.

The second bearing 37 is formed in a hollow cylindrical shape. The outer circumferential surface of the second bearing 37 may be fixed to the hole 54 of the boss 53. The inner circumferential surface of the second bearing 37 may support the rotation of the eccentric portion 62 of the rotating shaft 60. Accordingly, when the rotating shaft 60 rotates, the orbiting scroll 50 may rotate.

The second bearing 37 may be formed as an oilless bearing. For example, the second bearing 37 may be formed as a DU bush. The first bearing 27 and the second bearing 37 may be formed of the same type of bearing.

The orbiting wrap 52 of the orbiting scroll 50 is engaged with the fixed wrap 43 of the fixed scroll 40, and the boss 53 may be inserted into the shaft hole 21 of the main frame 20. In detail, the mirror plate 51 of the orbiting scroll 50 may be located on the upper protrusion 23 of the main frame 20, and the boss 53 may be located in the shaft hole 21.

When the orbiting scroll 50 is disposed in the main frame 20, the boss 53 of the orbiting scroll 50 is inserted into the shaft hole 21 of the main frame 20. At least a portion of the boss 53 of the orbiting scroll 50 may be located inside the shaft hole 21 of the main frame 20. In other words, the lower end of the boss 53 of the orbiting scroll 50 may be located below the upper surface of the upper protrusion 23 of the main frame 20. For example, the center of the boss 53 in the longitudinal direction of the boss 53 may be located below the upper protrusion 23 of the main frame 20.

The second bearing 37 is disposed in the hole 54 of the boss 53 of the orbiting scroll 50, and the first bearing 27 is disposed in the shaft hole 21 of the main frame 20. Accordingly, at least a portion of the second bearing 37 may be located inside the first bearing 27.

In other words, the first bearing 27 disposed between the shaft hole 21 of the main frame 20 and the rotating shaft 60 and the second bearing 37 disposed between the boss 53 of the orbiting scroll 50 and the eccentric portion 62 of the rotating shaft 60 may be overlapped in the axial direction. Here, the axial direction refers to a direction in which the rotating shaft 60 is viewed from one side of the rotating shaft 60. That is, the axial direction refers to the direction indicated by arrow S in FIG. 3. The fact that the second bearing 37 overlaps the first bearing 27 means that, when viewed in the axial direction, the second bearing 37 is located behind the first bearing 27 and the second bearing 37 is covered by the first bearing 27. It does not mean that the first bearing 27 and the second bearing 37 are in contact with each other.

Therefore, as illustrated in FIG. 3, when viewed in the axial direction S, the lower portion of the second bearing 37 overlaps the upper portion of the first bearing 27.

The drive motor 80 is disposed below the main frame 20. The drive motor 80 is configured to generate rotational force to rotate the orbiting scroll 50.

The drive motor 80 may include a stator 81 and a rotor 82. The stator 81 may be fixed to the inner surface of the casing 10. The rotor 82 may be rotatably disposed inside the stator 81.

In addition, the rotating shaft 60 may be inserted into the rotor 82 so as to penetrate the rotor 82. Because the rotor 82 is fixed to the rotating shaft 60, the rotor 82 and the rotating shaft 60 may rotate as one body.

The fixed scroll 40, the orbiting scroll 50, and the rotating shaft 60 may form the compression part that suctions, compresses, and discharges the refrigerant.

The rotating shaft 60 may include a shaft portion 61 formed to have a predetermined length and an eccentric portion 62 extending upward from an upper end of the shaft portion 61. The eccentric portion 62 may be formed integrally with the shaft portion 61. The central axis CA2 of the eccentric portion 62 is spaced apart by a predetermined distance from the rotation center of the rotating shaft 60, that is, the central axis CA1 of the shaft portion 61.

The rotor 82 of the drive motor 80 may be fixed to the shaft portion 61 of the rotating shaft 60. The upper end of the shaft portion 61 may be inserted into the shaft hole 21 of the main frame 20 and may be rotatably supported by the first bearing 27 disposed in the shaft hole 21.

The eccentric portion 62 formed at the upper end of the rotating shaft 60 may be inserted into the hole 54 of the boss 53 of the orbiting scroll 50. The eccentric portion 62 of the rotating shaft 60 may be supported by the second bearing 37 disposed in the boss 53 of the orbiting scroll 50.

A bearing support 70 may be disposed at the upper end of the rotating shaft 60, that is, the upper end of the shaft portion 61. The bearing support 70 is disposed on the rotating shaft 60 to surround the eccentric portion 62. The bearing support 70 may be rotatably supported by the first bearing 27 disposed on the main frame 20. That is, the first bearing 27 is interposed between the bearing support 70 and the main frame 20 and may support the rotation of the bearing support 70 coupled to the rotating shaft 60. The bearing support 70 will be described in detail below.

A balance weight 75 may be disposed on the shaft portion 61 of the rotating shaft 60 above the rotor 82. The balance weight 75 may be disposed below the bearing support 70. The balance weight 75 may be spaced apart by a predetermined distance from the bearing support 70 along the rotating shaft 60. The balance weight 75 may be disposed on the shaft portion 61 between the rotor 82 and the main frame 20. The balance weight 75 is provided to offset unbalance caused by eccentric rotation of the orbiting scroll 50.

The balance weight 75 may include a fixing hole 751. By inserting the rotating shaft 60 into the fixing hole 751, the balance weight 75 may be fixed to the rotating shaft 60. The balance weight 75 may be fixed to the rotating shaft 60 by press fitting. The diameter of the fixing hole 751 of the balance weight 75 and the diameter of the portion of the rotating shaft 60 where the balance weight 75 is disposed may be defined so that the rotating shaft 60 may be press-fitted into the fixing hole 751 of the balance weight 75.

A lower portion of the shaft portion 61 may be supported by a bearing 31 disposed on the sub frame 30 fixed to the casing 10. The bearing 31 of the sub frame 30 may be formed as a bush bearing. Accordingly, the rotating shaft 60 may rotate while being supported at both ends thereof by the main frame 20 and the sub frame 30.

In addition, an oil passage 66 may be formed in the rotating shaft 60 to penetrate the shaft portion 61 and the eccentric portion 62. An outlet 66*a* of the oil passage 66 is provided at an upper end of the eccentric portion 62.

An oil pump 33 for supplying oil from the oil reservoir 16 to the oil passage 66 may be disposed at the lower end of the rotating shaft 60. The lower end of the oil pump 33 may be submerged in the oil contained in oil reservoir 16 of the casing 10.

Therefore, when the rotating shaft 60 rotates, the oil stored in the oil reservoir 16 may be supplied to the oil passage 66 of the rotating shaft 60 by the pressure acting on the oil reservoir 16 and the oil pump 33.

The oil moved along the oil passage 66 may be supplied to the hole 54 of the boss 53 of the orbiting scroll 50 through the outlet 66*a*. In addition, the oil in the hole 54 of the boss 53 may lubricate the second bearing 37 and flow downward.

Referring to FIGS. 2, 3, and 7, the bearing support 70 may be disposed on the outer circumferential surface of the rotating shaft 60. The bearing support 70 may be disposed on the outer circumferential surface of the upper end of the shaft portion 61 of the rotating shaft 60. The bearing support 70 is formed separately from the rotating shaft 60 and may be coupled to the outer circumferential surface of the rotating shaft 60. The bearing support 70 may be coupled to the outer circumferential surface of the upper end of the shaft portion 61 of the rotating shaft 60. The bearing support 70 coupled to the rotating shaft 60 may rotate integrally with the rotating shaft 60.

The bearing support 70 may be formed in a hollow cylindrical shape. The hollow of the bearing support 70 may be formed to be eccentric with respect to the outer circumferential surface. In other words, the inner circumferential surface of the bearing support 70 is formed to be eccentric with respect to the outer circumferential surface of the bearing support 70. That is, the bearing support 70 may be formed so that the center of the inner circumferential surface of the bearing support 70 is eccentric with the center of the outer circumferential surface of the bearing support 70.

However, in another embodiment, the bearing support 70 may be formed so that the inner circumferential surface and the outer circumferential surface thereof are concentric. That is, the bearing support 70 may be formed so that the center of the inner circumferential surface of the bearing support 70 coincides with the center of the outer circumferential surface of the bearing support 70.

As illustrated in FIG. 7, when the hollow of the bearing support 70 is formed eccentrically, the bearing support 70 may function as a sub-balance weight that offsets the unbalance of the orbiting scroll 50. When the hollow of the bearing support 70 is formed concentrically with the outer circumferential surface, the bearing support 70 does not function as a sub-balance weight.

The bearing support 70 is formed to support the first bearing 27. When the bearing support 70 is coupled to the rotating shaft 60, the bearing support 70 may support the first bearing 27. That is, the outer circumferential surface of the bearing support 70 coupled to the rotating shaft 60 may support the inner circumferential surface of the first bearing 27. Accordingly, the rotating shaft 60 may be rotatably supported by the first bearing 27.

Because the first bearing 27 is fixed to the main frame 20, the bearing support 70 may rotate with respect to the first bearing 27. The bearing support 70 is coupled to the upper end of the shaft portion 61 of the rotating shaft 60 and may rotate integrally with the rotating shaft 60. Therefore, the rotation of the rotating shaft 60 may be supported by the first bearing 27.

The bearing support 70 is formed in a hollow cylindrical shape, and may be coupled to the outer circumferential surface of the rotating shaft 60 by press-fitting. The length of the bearing support 70 may be the same as or similar to the length of the first bearing 27.

As an example, the bearing support 70 may include a coupling hole 71 and a boss receiving groove 72.

The coupling hole 71 may be formed at one end of the bearing support 70. The coupling hole 71 is formed to be coupled to the upper end of the shaft portion 61 of the rotating shaft 60. The coupling hole 71 may be disposed concentrically with the shaft portion 61 of the rotating shaft 60.

The coupling hole 71 may be formed to have a step. In other words, the coupling hole 71 may include a first coupling hole 711 and a second coupling hole 712 formed concentrically. The second coupling hole 712 is formed at one end of the first coupling hole 711. The diameter of the first coupling hole 711 may be larger than the diameter of the second coupling hole 712. Accordingly, the inner circumferential surface of the first coupling hole 711 and the inner circumferential surface of the second coupling hole 712 may form the step.

The first coupling hole 711 is formed to have a diameter corresponding to the outer circumferential surface of the upper end of the shaft portion 61 of the rotating shaft 60. Accordingly, the upper end of the shaft portion 61 of the rotating shaft 60 may be inserted into the coupling hole 71.

The diameter of the first coupling hole 711 and the diameter of the upper end of the shaft portion 61 of the rotating shaft 60 may be defined so that the upper end of the shaft portion 61 of the rotating shaft 60 is press-fitted to the first coupling hole 711 of the bearing support 70. Accordingly, the bearing support 70 may be press-fitted to the upper end of the rotating shaft 60.

The rotating shaft 60 includes a step portion 63 to which the bearing support 70 is coupled. The step portion 63 may be provided at the upper end of the shaft portion 61 of the rotating shaft 60. Accordingly, the step portion 63 may be located below the eccentric portion 62. The step portion 63 of the rotating shaft 60 is formed to correspond to the step of the coupling hole 71 of the bearing support 70. The step portion 63 may be inserted into the second coupling hole 712 of the bearing support 70. The step portion 63 of the rotating shaft 60 may be formed to be press-fitted into the second coupling hole 712 of the bearing support 70.

The boss receiving groove 72 may be formed at the other end of the bearing support 70. The boss receiving groove 72 may be formed at a predetermined depth on the other end of the bearing support 70. The boss receiving groove 72 may be formed so that the boss 53 of the orbiting scroll 50 is inserted therein. The diameter of the boss receiving groove 72 is formed to be larger than the outer diameter of the boss 53 of the orbiting scroll 50.

Therefore, when the eccentric portion 62 of the rotating shaft 60 is inserted into the boss 53 of the orbiting scroll 50, the boss 53 of the orbiting scroll 50 is accommodated in the boss receiving groove 72 of the bearing support 70. In this case, a gap exists between the outer circumferential surface of the boss 53 and the inner circumferential surface of the boss receiving groove 72. Oil supplied to the boss 53 through the oil passage 66 may be accommodated in the space between the boss 53 and the boss receiving groove 72.

The boss receiving groove 72 may be formed to have a circular cross-section. The bottom surface of the boss receiving groove 72 may communicate with the coupling hole 71. Accordingly, the eccentric portion 62 of the rotating shaft 60 may protrude into the boss receiving groove 72 through the coupling hole 71.

The boss receiving groove 72 may be formed to be eccentric with the coupling hole 71. In other words, the boss receiving groove 72 may be formed so that the center of the boss receiving groove 72 is not located on a straight line with the center of the coupling hole 71. When the boss receiving groove 72 is eccentric with respect to the coupling hole 71, the inner circumferential surface of the boss receiving groove 72 is eccentric with respect to the outer circumferential surface of the bearing support 70.

The inner circumferential surface of the boss receiving groove 72 forms the inner circumferential surface of the bearing support 70. Accordingly, the inner circumferential surface of the bearing support 70 may be formed to be eccentric with respect to the outer circumferential surface of the bearing support 70.

Referring to FIGS. 3 and 4, the bearing support 70 is coupled to the upper end of the rotating shaft 60, and the bearing support 70 is inserted into the shaft hole 21 of the main frame 20. At this time, the first bearing 27 is interposed between the outer circumferential surface of the bearing support 70 and the inner circumferential surface of the shaft hole 21 of the main frame 20. Accordingly, the rotation of the rotating shaft 60 may be supported by the first bearing 27.

In addition, the boss 53 of the orbiting scroll 50 is accommodated in the boss receiving groove 72 of the bearing support 70 coupled to the rotating shaft 60. The eccentric portion 62 of the rotating shaft 60 is inserted into the hole 54 of the boss 53 of the orbiting scroll 50. At this time, the second bearing 37 is interposed between the inner circumferential surface of the boss 53 and the eccentric portion 62. Accordingly, the rotation of the eccentric portion 62 of the rotating shaft 60 may be supported by the second bearing 37.

Referring to FIGS. 3 and 4, the second bearing 37 disposed between the boss 53 and the eccentric portion 62 is located inside the boss receiving groove 72 of the bearing support 70. Because the first bearing 27 is disposed on the outer circumferential surface of the bearing support 70, the second bearing 37 is located inside the first bearing 27. The lower end of the second bearing 37 may be located below the upper end of the first bearing 27. In other words, at least a portion of the second bearing 37 may overlap with the first bearing 27 in the axial direction S. For example, the second bearing 37 may be disposed so that the center LC of the second bearing 37 in the longitudinal direction is located below the upper end of the first bearing 27. As another example, the second bearing 37 may be disposed so that the entire length of the second bearing 37 overlaps the first bearing 27 in the axial direction S.

Accordingly, the first bearing 27 and the second bearing 37 are arranged to overlap in the axial direction S. In other words, the second bearing 37 is arranged to overlap the first bearing 27 in the radial direction of the main frame 20 (direction of arrow R in FIG. 4).

As another example, the boss receiving groove 72 may be formed concentrically with the coupling hole 71. In other words, the boss receiving groove 72 may be formed so that the center of the boss receiving groove 72 and the center of the coupling hole 71 are located on the same axis.

The bearing support 70 may include an oil hole 73. The oil hole 73 may be formed on the outer circumferential surface of the bearing support 70 to communicate with the boss receiving groove 72. The oil hole 73 may be formed adjacent to the bottom of the boss receiving groove 72.

Oil that has passed through the second bearing 37 may be accommodated in the boss receiving groove 72 of the bearing support 70. The oil contained in the boss receiving groove 72 may be supplied to the first bearing 27 through the oil hole 73.

As described above, when the bearing support 70 is formed separately from the rotating shaft 60, the external cylindrical grinding may be performed on the eccentric portion 62 of the rotating shaft 60. Therefore, the surface roughness of the outer circumferential surface of the eccentric portion 62 may be processed to the same surface roughness as that of the outer circumferential surface of the bearing support 70.

As in the prior art, the bearing support may be formed integrally with the rotating shaft to surround the eccentric portion. In this case, the outer circumferential surface of the bearing support is supported by the first bearing 27. The outer circumferential surface of the eccentric portion is supported by the second bearing 37. Therefore, the bearing support and the eccentric portion need to be formed to have high surface roughness so that they may be supported by the first bearing 27 and the second bearing 37, respectively.

Because the outer circumferential surface of the bearing support formed integrally with the rotating shaft is exposed to the outside, it may be formed to have high surface roughness by performing the external cylindrical grinding with a grinding wheel.

However, the eccentric portion is located inside the bearing support. Therefore, the outer circumferential surface of the eccentric portion cannot be processed by performing the external cylindrical grinding with the grinding wheel. A special grinding tool is required to grind the outer circumferential surface of the eccentric portion. The outer circumferential surface of the eccentric portion cannot be ground with a general grinding wheel.

Accordingly, in the rotating shaft according to the prior art in which the bearing support is formed integrally, it is difficult to grind the outer circumferential surface of the eccentric portion to have the same surface roughness as the outer circumferential surface of the bearing support.

However, in the case of the scroll compressor 1 according to one or more embodiments of the disclosure, the bearing support 70 is formed separately from the rotating shaft 60. Accordingly, in the rotating shaft 60 according to one or more embodiments of the disclosure, as illustrated in FIG. 8, the outer circumferential surface of the eccentric portion 62 may be ground by the external cylindrical grinding using a general grinding wheel.

Figure 8:
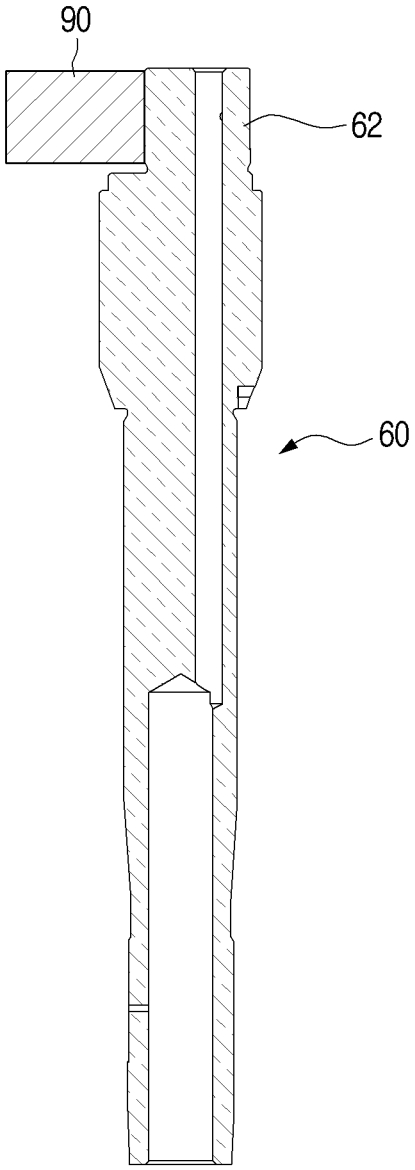
FIG. 8 is a cross-sectional view illustrating a rotating shaft of a scroll compressor according to one or more embodiments of the disclosure.

FIG. 8 is a cross-sectional view illustrating a case of grinding an eccentric portion 62 of a rotating shaft 60 of a scroll compressor 1 according to one or more embodiments of the disclosure with a grinding wheel 90.

As illustrated in FIG. 8, after performing the external cylindrical grinding with a general grinding wheel 90 on the eccentric portion 62 of the rotating shaft 60, the bearing support 70 may be coupled to the upper end of the rotating shaft 60. Accordingly, in the rotating shaft 60 according to one or more embodiments of the disclosure, the outer circumferential surface of the eccentric portion 62 of the rotating shaft 60 may be ground to have the same surface roughness as the outer circumferential surface of the bearing support 70.

Therefore, the processing deviation and processing cost of the eccentric portion 62 of the rotating shaft 60 may be reduced. In addition, because the surface roughness of the eccentric portion 62 of the rotating shaft 60 is improved, the friction loss of the second bearing 37 may be reduced.

In addition, as described above, when the first bearing 27 disposed in the main frame 20 and the second bearing 37 disposed in the orbiting scroll 50 are arranged to overlap in the axial direction, the distance from the upper end of the orbiting scroll 50 to the center of the first bearing 27 supporting the rotating shaft 60 may be reduced.

In the case of a scroll compressor according to the prior art having a structure in which the first bearing 27 and the second bearing 37 do not overlap in the axial direction, the distance from the upper end of the orbiting scroll 50 to the center of the first bearing 27 supporting the rotating shaft 60 is farther than the distance from the upper end of the orbiting scroll 50 to the center of the first bearing 27 supporting the rotating shaft 60 in the scroll compressor 1 according to one or more embodiments of the disclosure.

Therefore, in the scroll compressor 1 according to one or more embodiments of the disclosure, when compressing the refrigerant by rotation of the orbiting scroll 50, the moment applied to the orbiting scroll 50 centered on the first bearing 27 may be reduced. Then, the leakage of the refrigerant through the gap between the orbiting scroll 50 and the fixed scroll 40 during refrigerant compression may be reduced, thereby improving the compression efficiency of the scroll compressor 1.

Hereinafter, the compression part of the scroll compressor 1 according to one or more embodiments of the disclosure will be described in detail with FIGS. 9 to 12.

Figure 9:
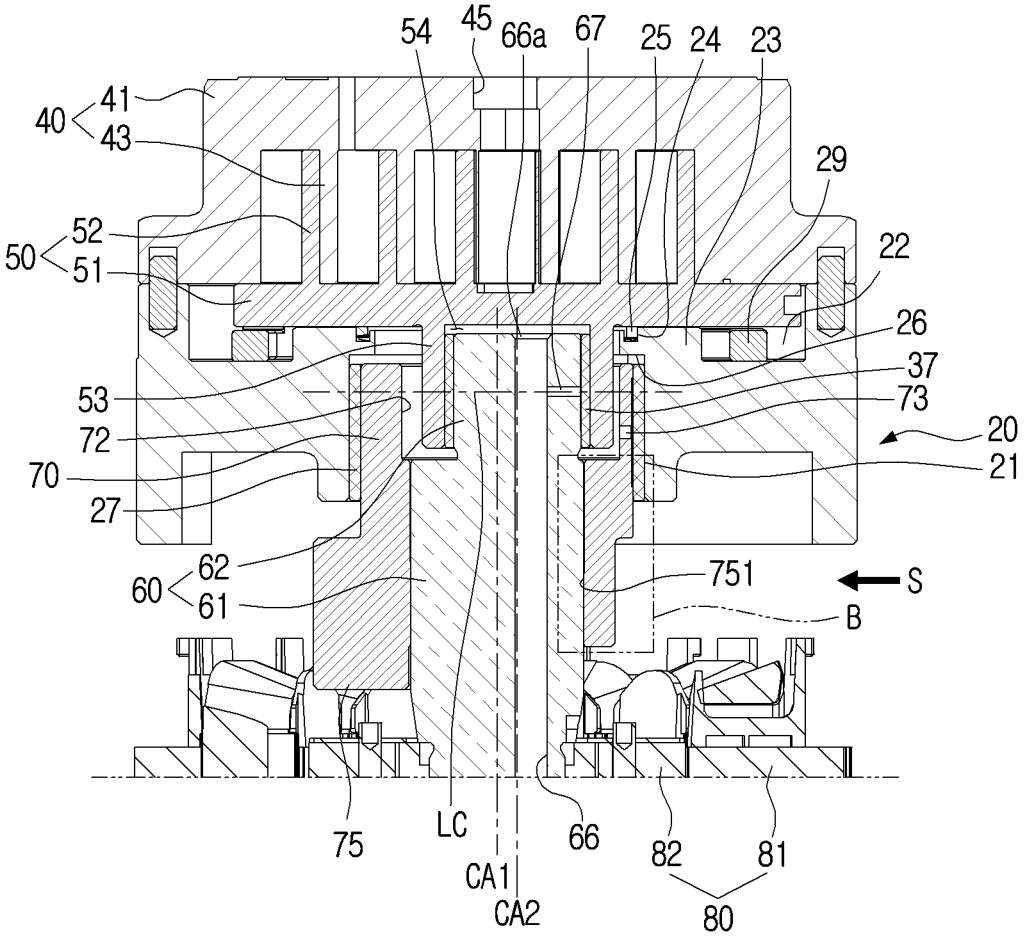
FIG. 9 is a partially enlarged cross-sectional view illustrating a compression part of a scroll compressor according to one or more embodiments of the disclosure.
Figure 10:
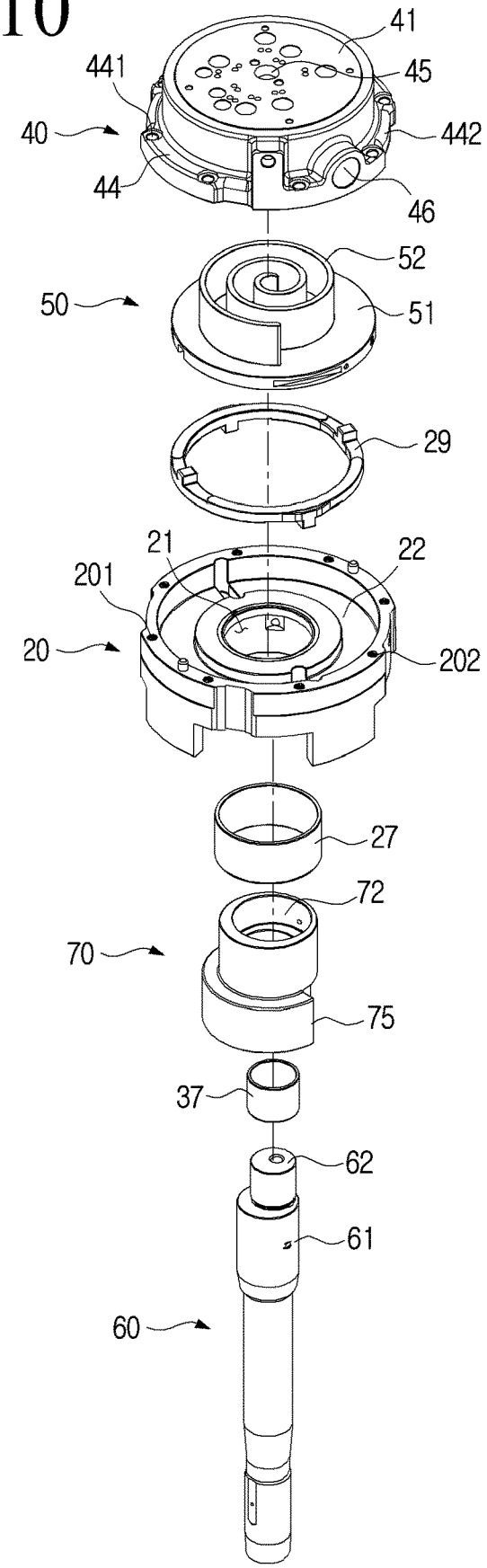
FIG. 10 is an exploded perspective view illustrating main parts of a scroll compressor according to one or more embodiments of the disclosure.
Figure 11:
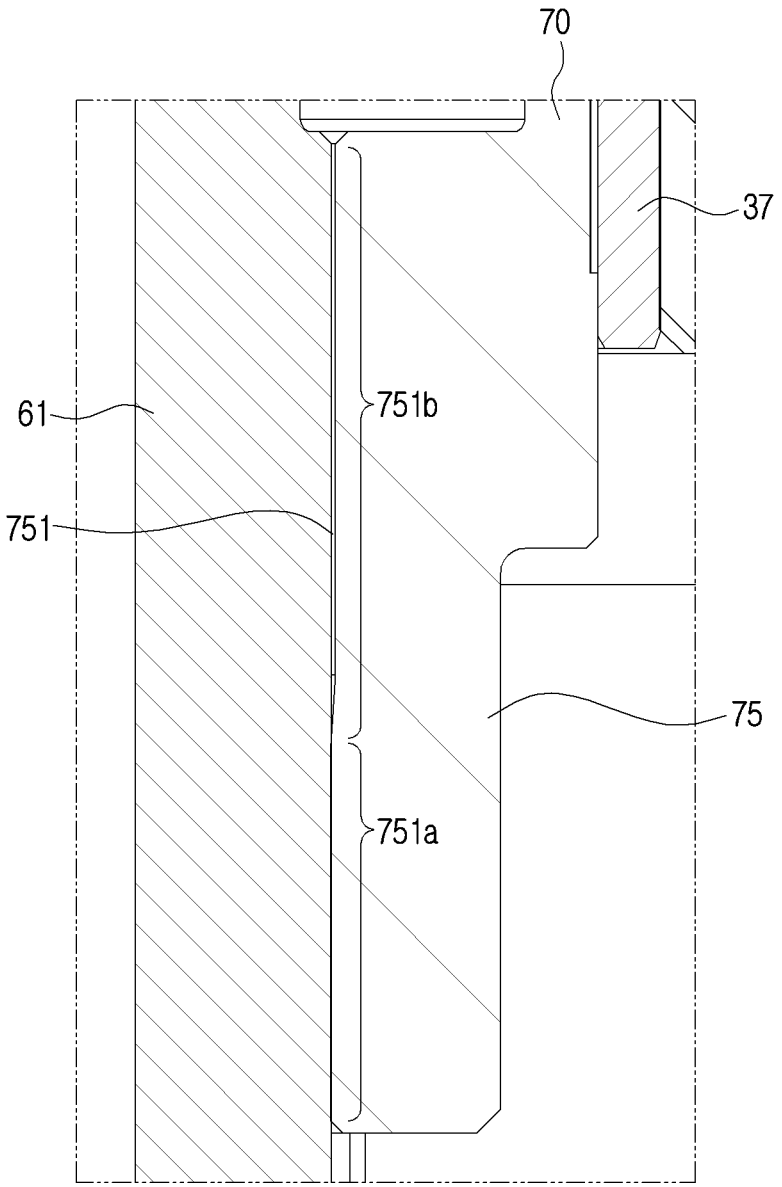
FIG. 11 is a partially enlarged cross-sectional view illustrating a part B of FIG. 9.
Figure 12:
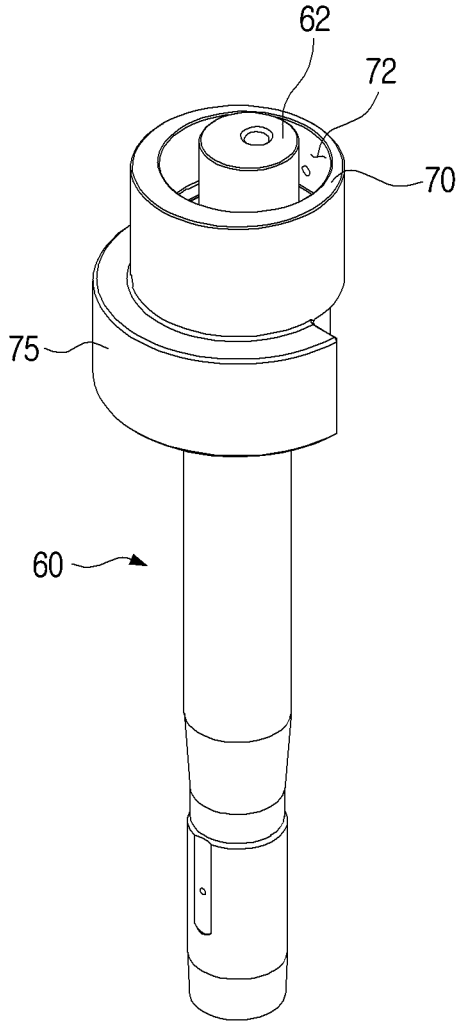
FIG. 12 is a perspective view illustrating a state in which a balance weight according to one or more embodiments of the disclosure is press-fitted into a rotating shaft.

FIG. 9 is a partially enlarged cross-sectional view illustrating a compression part of a scroll compressor 1 according to one or more embodiments of the disclosure. FIG. 10 is an exploded perspective view illustrating main parts of a scroll compressor 1 according to one or more embodiments of the disclosure. FIG. 11 is a partially enlarged cross-sectional view illustrating a part B of FIG. 9. FIG. 12 is a perspective view illustrating a state in which a balance weight 75 of a scroll compressor 1 according to one or more embodiments of the disclosure is press-fitted into a rotating shaft 60.

Referring to FIGS. 9 and 10, the compression part of the scroll compressor 1 according to one or more embodiments of the disclosure may include a main frame 20, a fixed scroll 40, an orbiting scroll 50, and a rotating shaft 60.

The compression part of the scroll compressor 1 shown in FIGS. 9 and 10 may be disposed inside the casing 10 in the same manner as the compression part of the scroll compressor 1 shown in FIGS. 1 and 2.

The main frame 20, the fixed scroll 40, and the orbiting scroll 50 are the same as the scroll compressor 1 according to the above-described embodiment. Therefore, duplicate descriptions are omitted.

The rotor 82 of the drive motor 80 is fixed to the rotating shaft 60. Accordingly, the rotating shaft 60 may rotate integrally with the rotor 82.

The rotating shaft 60 may include a shaft portion 61 formed to have a predetermined length and an eccentric portion 62 extending upward from the upper end of the shaft portion 61. The eccentric portion 62 is formed integrally with the shaft portion 61. The central axis CA2 of the eccentric portion 62 is spaced apart by a predetermined distance from the rotation center of the rotating shaft 60, that is, the central axis CA1 of the shaft portion 61.

The rotor 82 of the drive motor 80 may be fixed to the shaft portion 61 of the rotating shaft 60. One end of the shaft portion 61 is inserted into the shaft hole 21 of the main frame 20 and may be rotatably supported by the first bearing 27 disposed in the shaft hole 21.

The eccentric portion 62 formed at the upper end of the rotating shaft 60 may be inserted into the hole 54 of the boss 53 of the orbiting scroll 50. The eccentric portion 62 of the rotating shaft 60 may be supported by the second bearing 37 disposed in the boss 53 of the orbiting scroll 50.

The bearing support 70 may be disposed at the upper end of the rotating shaft 60, that is, the upper end of the shaft portion 61. The bearing support 70 is disposed on the rotating shaft 60 to surround the eccentric portion 62. The bearing support 70 may be rotatably supported by the first bearing 27 disposed on the main frame 20. In other words, the first bearing 27 is interposed between the bearing support 70 and the main frame 20 and may support the rotation of the bearing support 70 coupled to the rotating shaft 60. Accordingly, the rotating shaft 60 may be rotatably supported by the first bearing 27.

A balance weight 75 may be formed below the bearing support 70. The balance weight 75 may be formed integrally with the bearing support 70. The balance weight 75 may be formed extending from the lower end of the bearing support 70.

The balance weight 75 may be disposed on the shaft portion 61 of the rotating shaft 60 to be positioned between the main frame 20 and the rotor 82. The balance weight 75 may be formed so as not to interfere with the main frame 20 when the rotating shaft 60 rotates.

The balance weight 75 may include a fixing hole 751. By inserting the rotating shaft 60 into the fixing hole 751, the balance weight 75 may be fixed to the rotating shaft 60. The balance weight 75 may be fixed to the rotating shaft 60 by press fitting. The diameter of the fixing hole 751 of the balance weight 75 and the diameter of the portion of the rotating shaft 60 where the balance weight 75 is disposed may be defined so that the rotating shaft 60 is press-fitted into the fixing hole 751 of the balance weight 75.

As an example, the balance weight 75 may be formed such that the rotating shaft 60 is press-fitted into the entire length of the fixing hole 751 of the balance weight 75.

As an example, as illustrated in FIG. 11, the diameter of a portion 751*a* of the fixing hole 751 of the balance weight 75 in the longitudinal direction may be defined so that the rotating shaft 60 is press-fitted into it, and the diameter of the remaining portion 751*b* of the fixing hole 751 may be defined so that there is a gap between the rotating shaft 60 and the fixing hole 751.

The bearing support 70 and the balance weight 75, which are integrally formed, are provided to offset the unbalance caused by eccentric rotation of the orbiting scroll 50.

Referring to FIGS. 9, 10, and 12, the bearing support 70 may be formed integrally with the balance weight 75. The integrated bearing support 70 and balance weight 75 are formed separately from the rotating shaft 60, and may be coupled to the outer circumferential surface of the rotating shaft 60. When the balance weight 75 is coupled to the rotating shaft 60, the bearing support 70 is fixed to the rotating shaft 60. The bearing support 70 fixed to the rotating shaft 60 may rotate integrally with the rotating shaft 60.

The bearing support 70 may be formed in a hollow cylindrical shape. The hollow of the bearing support 70 may be formed to be eccentric with respect to the outer circumferential surface. In other words, the inner circumferential surface of the bearing support 70 is formed to be eccentric with respect to the outer circumferential surface of the bearing support 70. That is, the bearing support 70 may be formed so that the center of the inner circumferential surface of the bearing support 70 is eccentric with the center of the outer circumferential surface of the bearing support 70.

As another embodiment, the bearing support 70 may be formed so that its inner circumferential surface and outer circumferential surface are concentric. That is, the bearing support 70 may be formed so that the center of the inner circumferential surface of the bearing support 70 coincides with the center of the outer circumferential surface of the bearing support 70.

As illustrated in FIG. 9, when the hollow of the bearing support 70 is formed eccentrically, the bearing support 70 may function as a sub-balance weight that offsets the unbalance of the orbiting scroll 50 together with the balance weight 75. When the hollow of the bearing support 70 is formed concentrically with the outer circumferential surface, the bearing support 70 does not function as a sub-balance weight.

The bearing support 70 is formed to support the first bearing 27. When the bearing support 70 is fixed to the rotating shaft 60 by the balance weight 75, the bearing support 70 may support the first bearing 27. That is, the outer circumferential surface of the bearing support 70 fixed to the rotating shaft 60 may support the inner circumferential surface of the first bearing 27. Accordingly, the rotating shaft 60 may be rotatably supported by the first bearing 27.

Because the first bearing 27 is fixed to the shaft hole 21 of the main frame 20, the bearing support 70 may rotate with respect to the first bearing 27. The bearing support 70 is formed integrally with the balance weight 75, and the balance weight 75 rotates integrally with the rotating shaft 60, so the rotation of the rotating shaft 60 may be supported by the first bearing 27.

The hollow of the bearing support 70 may form a boss receiving groove 72.

The boss receiving groove 72 may be formed at one end of the bearing support 70. The boss receiving groove 72 may be formed at a predetermined depth on one end of the bearing support 70. The boss receiving groove 72 may be formed so that the boss 53 of the orbiting scroll 50 is inserted therein.

The diameter of the boss receiving groove 72 is formed to be larger than the outer diameter of the boss 53 of the orbiting scroll 50. Therefore, when the eccentric portion 62 of the rotating shaft 60 is inserted into the boss 53 of the orbiting scroll 50, the boss 53 of the orbiting scroll 50 is accommodated in the boss receiving groove 72 of the bearing support 70. In this case, a gap exists between the outer circumferential surface of the boss 53 and the inner circumferential surface of the boss receiving groove 72. Oil supplied to the boss 53 through the oil passage 66 may be accommodated in the space between the boss 53 and the boss receiving groove 72.

The boss receiving groove 72 may be formed to have a circular cross-section. The bottom surface of the boss receiving groove 72 may communicate with the fixing hole 751 of the balance weight 75. Accordingly, the eccentric portion 62 of the rotating shaft 60 may protrude into the boss receiving groove 72 through the fixing hole 751 of the balance weight 75.

The boss receiving groove 72 may be formed to be eccentric with the fixing hole 751. In other words, the boss receiving groove 72 of the bearing support 70 may be formed so that the center of the boss receiving groove 72 is not located on a straight line with the center of the fixing hole 751 of the balance weight 75. When the boss receiving groove 72 is eccentric with respect to the fixing hole 751, the inner circumferential surface of the boss receiving groove 72 is eccentric with respect to the outer circumferential surface of the bearing support 70.

The inner circumferential surface of the boss receiving groove 72 forms the inner circumferential surface of the bearing support 70. Accordingly, the inner circumferential surface of the bearing support 70 may be formed to be eccentric with respect to the outer circumferential surface of the bearing support 70.

In addition, an oil passage 66 may be formed in the rotating shaft 60 to penetrate the shaft portion 61 and the eccentric portion 62. An outlet 66*a* of the oil passage 66 is provided at the upper end of the eccentric portion 62.

Referring to FIG. 9, the bearing support 70 is coupled to the upper end of the rotating shaft 60 by the balance weight 75, and the bearing support 70 is inserted into the shaft hole 21 of the main frame 20. At this time, the first bearing 27 is interposed between the outer circumferential surface of the bearing support 70 and the inner circumferential surface of the shaft hole 21 of the main frame 20. Accordingly, the rotation of the rotating shaft 60 may be supported by the first bearing 27.

In addition, the boss 53 of the orbiting scroll 50 is accommodated in the boss receiving groove 72 of the bearing support 70 coupled to the rotating shaft 60. The eccentric portion 62 of the rotating shaft 60 is inserted into the hole 54 of the boss 53 of the orbiting scroll 50. At this time, the second bearing 37 is interposed between the inner circumferential surface of the boss 53 and the eccentric portion 62. Accordingly, the rotation of the eccentric portion 62 of the rotating shaft 60 may be supported by the second bearing 37.

The second bearing 37 disposed between the boss 53 and the eccentric portion 62 is located inside the boss receiving groove 72 of the bearing support 70. Because the first bearing 27 is disposed on the outer circumferential surface of the bearing support 70, the second bearing 37 is located inside the first bearing 27. The lower end of the second bearing 37 may be located below the upper end of the first bearing 27. At least a portion of the second bearing 37 may overlap with the first bearing 27 in the axial direction (direction S of arrow in FIG. 9). For example, the second bearing 37 may be disposed so that the center LC of the second bearing 37 in the longitudinal direction is located below the upper end of the first bearing. As another example, the second bearing 37 may be disposed so that the entire length of the second bearing 37 overlaps the first bearing 27 in the axial direction S.

Accordingly, the first bearing 27 and the second bearing 37 are arranged to overlap in the axial direction S.

The bearing support 70 may include an oil hole 73. The oil hole 73 may be formed on the outer circumferential surface of the bearing support 70 to communicate with the boss receiving groove 72. The oil hole 73 may be formed adjacent to the bottom of the boss receiving groove 72.

Oil that has passed through the second bearing 37 may be accommodated in the boss receiving groove 72 of the bearing support 70. The oil contained in the boss receiving groove 72 may be supplied to the first bearing 27 through the oil hole 73.

As described above, when the balance weight 75 including the bearing support 70 is formed separately from the rotating shaft 60, the external cylindrical grinding may be performed on the eccentric portion 62 of the rotating shaft 60 before coupling the balance weight 75 including the bearing support 70 to the rotating shaft 60. Therefore, the surface roughness of the outer circumferential surface of the eccentric portion 62 may be processed to the same surface roughness as that of the outer circumferential surface of the bearing support 70.

As a result, the processing deviation and processing cost of the eccentric portion 62 of the rotating shaft 60 may be reduced. In addition, because the surface roughness of the eccentric portion 62 of the rotating shaft 60 is improved, the friction loss of the second bearing 37 may be reduced.

In addition, when the bearing support 70 and the balance weight 75 are formed integrally as described above, the bearing support 70 may be disposed on the rotating shaft 60 simply by coupling the balance weight 75 to the rotating shaft 60. Therefore, the manufacturing cost of the scroll compressor 1 may be reduced.

While the disclosure has been illustrated and described with reference to various example embodiments thereof, it will be understood that the various example embodiments are intended to be illustrative, not limiting. It will be understood by those skilled in the art that various changes in form and details may be made therein without departing from the true spirit and full scope of the disclosure, including the appended claims and their equivalents.

What is claimed is:

1. A scroll compressor comprising:

a main frame including a shaft hole;

a fixed scroll disposed on an upper side of the main frame;

an orbiting scroll disposed in a space formed by the fixed scroll and the main frame, a lower surface of the orbiting scroll including a boss having an opening therein and the boss being inserted into the shaft hole of the main frame;

a rotatable shaft including an eccentric portion inserted into the opening of the boss and an upper end of the rotatable shaft including a step portion, the rotatable shaft inserted into the shaft hole of the main frame;

a bearing support coupled to the step portion of the rotatable shaft, the bearing support being separatable from, and couplable to, the rotatable shaft;

a first bearing disposed in the shaft hole between inner surface of the shaft hole and the bearing support, an inner circumferential surface of the first bearing being supported by an outer circumferential surface of the bearing support; and a second bearing disposed between an inner surface of the boss and an outer surface of the eccentric portion of the rotatable shaft, such that the second bearing overlaps the first bearing in an axial direction of the rotatable shaft.

2. The scroll compressor of claim 1, wherein the bearing support has a hollow cylindrical shape and is press-fit to the outer circumferential surface of an upper end of the rotatable shaft.

3. The scroll compressor of claim 2, wherein the step portion is located below the eccentric portion.

4. The scroll compressor as claimed in claim 2, wherein the inner circumferential surface of the bearing support is eccentric with respect to the outer circumferential surface of the bearing support.

5. The scroll compressor as claimed in claim 1, wherein the bearing support includes an oil hole.

6. The scroll compressor as claimed in claim 1, wherein the first bearing and the second bearing are oilless bearings.

7. The scroll compressor as claimed in claim 1, wherein an outer circumferential surface of the first bearing is fixed to the shaft hole of the main frame, and an inner circumferential surface of the first bearing rotatably supports the outer circumferential surface of the bearing support.

8. The scroll compressor as claimed in claim 1, wherein an outer circumferential surface of the second bearing is fixed to an inner circumferential surface of the boss of the orbiting scroll, and an inner circumferential surface of the second bearing rotatably supports an outer circumferential surface of the eccentric portion of the rotatable shaft.

9. A scroll compressor comprising:

a main frame including a shaft hole;

a fixed scroll disposed on an upper side of the main frame;

an orbiting scroll disposed in a space formed by the fixed scroll and the main frame, a lower surface of the orbiting scroll including a boss having an opening therein and the boss being inserted into the shaft hole of the main frame;

a rotatable shaft including an eccentric portion inserted into the opening of the boss and upper end of the rotatable shaft including a step portion of the orbiting scroll and the rotatable shaft inserted into the shaft hole of the main frame;

a first bearing disposed in the shaft hole between an inner surface of the shaft hole and the rotatable shaft;

a second bearing disposed between an inner surface of the opening of the boss and an outer surface of the eccentric portion of the rotatable shaft; and a bearing support having a cylindrical shape around a hollow, the bearing support being separatable from, and couplable to, the step portion the rotatable shaft to support an inner circumferential surface of the first bearing, wherein a portion of the second bearing is located in the hollow of the bearing support.

10. The scroll compressor of claim 9, wherein a lower end of the second bearing is located below an upper end of the first bearing in an axial direction of the rotatable shaft.

11. The scroll compressor of claim 9, wherein the bearing support is press-fit to an outer circumferential surface of an upper end of the rotatable shaft.

* * * * *